US012742274B2

(12) United States Patent
Galiano et al.

(10) Patent No.: US 12,742,274 B2
(45) Date of Patent: Sep. 22, 2026

(54) BASEBALL SEWING DEVICE, SYSTEM, AND METHOD

(71) Applicant: Project Predator, LLC, Dix Hills, NY (US)

(72) Inventors: Charles Galiano, Dix Hills, NY (US); Thomas Riccio, Port Jefferson Station, NY (US); Christopher Edwards, East Northport, NY (US); Nicholas Carlson, Kings Park, NY (US); Robert Riecker, Jr., Lindenhurst, NY (US)

(73) Assignee: Project Predator LLC, Dix Hills, NY (US)

( * ) Notice: Subject to any disclaimer, the term of this patent is extended or adjusted under 35 U.S.C. 154(b) by 0 days.

(21) Appl. No.: 19/311,088

(22) Filed: Aug. 27, 2025

(65) Prior Publication Data

US 2026/0061260 A1 Mar. 5, 2026

Related U.S. Application Data

(63) Continuation of application No. 18/930,965, filed on Oct. 29, 2024.

(60) Provisional application No. 63/819,645, filed on Jun. 7, 2025, provisional application No. 63/750,811, filed on Jan. 29, 2025, provisional application No. 63/750,509, filed on Jan. 28, 2025, provisional application No. 63/687,443, filed on Aug. 27, 2024.

(51) Int. Cl.
*D05B 23/00* (2006.01)
*A63B 37/04* (2006.01)

(52) U.S. Cl.
CPC ..... *D05B 23/00* (2013.01); *A63B 37/04* (2013.01)

(58) Field of Classification Search
CPC ..... D05B 27/00; D05B 13/00; D05B 23/00; D05B 15/00; D05B 31/00; D05C 9/04
USPC ..... 112/475.08, 475.17
See application file for complete search history.

(56) References Cited

U.S. PATENT DOCUMENTS 1,167,265 A * 1/1916 Brusseau ..... D05B 31/00 112/470.35
2,976,827 A * 3/1961 Bauder, Jr. ..... D05B 23/00 112/470.35
3,151,584 A * 10/1964 Fossa ..... D05B 31/00 112/470.35
3,179,075 A * 4/1965 Fossa ..... D05B 31/00 112/475.08
4,248,165 A * 2/1981 Addy ..... D05B 81/00 112/470.35

(Continued)

*Primary Examiner* — Danny Worrell
(74) *Attorney, Agent, or Firm* — Shore IP Group, PLLC; Sean R. Wilsusen

(57) ABSTRACT

A robotic device for sewing a ball includes a platform, a first arm, a second arm, a first claw, a second claw, and a controller. The platform is configured to support a film for supporting two ball cover halves in a single plane. The first arm is positioned above the platform. The second arm is positioned below the platform. T first claw is supported by the first arm and is configured to releasably grasp a first needle. The second claw is supported by the second arm and is configured to releasably grasp the first needle. The controller is disposed in communication with the first arm, the second arm, the first claw, and the second claw, and is configured to move the first arm, the second arm, the first claw, and the second claw such that the first needle follows a first needle path.

12 Claims, 10 Drawing Sheets

(56) References Cited

U.S. PATENT DOCUMENTS 4,327,655 A * 5/1982 Addy ..... D05B 81/00 112/222
4,762,455 A * 8/1988 Coughlan ..... B25J 19/023 901/8
5,313,897 A * 5/1994 Katamine ..... D05B 73/00 112/470.13
5,381,743 A * 1/1995 Moll ..... D05B 23/00 112/470.13
5,875,726 A * 3/1999 Keilmann ..... B25J 9/0084 112/475.08
5,988,085 A * 11/1999 Martz ..... D05B 39/00 112/475.08
6,129,031 A * 10/2000 Sarh ..... D05B 25/00 901/41
7,287,479 B1 * 10/2007 Huang ..... D05B 31/00 112/470.35
7,308,860 B2 * 12/2007 Singh ..... D05C 9/04 112/470.35
7,363,869 B1 * 4/2008 Yang ..... D05B 15/02 112/62
10,240,271 B2 * 3/2019 Freer ..... D05B 23/00
10,358,754 B2 * 7/2019 Sano ..... B25J 18/04
10,450,683 B2 * 10/2019 Hirayama ..... D05B 35/00
10,626,535 B2 * 4/2020 Kadowaki ..... B25J 15/0019
10,815,594 B2 * 10/2020 Goto ..... D05B 33/00
11,174,579 B2 * 11/2021 Ikadai ..... D05B 69/02
12,522,962 B2 * 1/2026 Dong ..... D05B 19/14
2006/0254485 A1 * 11/2006 Singh ..... D05B 23/00 112/80.55
2016/0008673 A1 * 1/2016 Lin ..... A63B 45/00 156/93
2017/0260670 A1 * 9/2017 Freer ..... B25J 11/00
2018/0044830 A1 * 2/2018 Kadowaki ..... D05B 69/00
2018/0080155 A1 * 3/2018 Sano ..... D05B 87/00
2019/0119842 A1 * 4/2019 Goto ..... B25J 19/023
2019/0360141 A1 * 11/2019 Ikadai ..... D05B 1/10
2021/0000591 A1 * 1/2021 Limsakoune ..... A61F 2/2412
2021/0140084 A1 * 5/2021 Takamura ..... D05B 31/00
2021/0292951 A1 * 9/2021 Takamura ..... D05B 39/00
2022/0275552 A1 * 9/2022 Takamura ..... D05B 59/00
2022/0290346 A1 * 9/2022 Takamura ..... D05B 35/00
2022/0290347 A1 * 9/2022 Morimoto ..... D05B 69/10
2023/0279595 A1 * 9/2023 Wendel ..... D05B 19/00 112/220
2024/0165906 A1 * 5/2024 Yanagisawa ..... B25J 9/1697
2024/0175179 A1 * 5/2024 Fujie ..... B25J 9/1682
2025/0043477 A1 * 2/2025 Dong ..... D05B 1/20
2025/0050505 A1 * 2/2025 Dong ..... B25J 9/1697
2025/0050508 A1 * 2/2025 Dong ..... B25J 9/1679
2025/0059691 A1 * 2/2025 Yang ..... D05B 47/00
2025/0153446 A1 * 5/2025 Aumann ..... D05B 17/00
2025/0179707 A1 * 6/2025 Sawada ..... D05B 35/064

* cited by examiner

BASEBALL SEWING DEVICE, SYSTEM, AND METHOD

CROSS-REFERENCE TO RELATED APPLICATIONS

The present application claims the benefits of and priority to U.S. Provisional Patent Application Ser. No. 63/819,645, filed on Jun. 7, 2025, U.S. Provisional Patent Application Ser. No. 63/750,811, filed on Jan. 29, 2025, U.S. Provisional Patent Application Ser. No. 63/750,509, filed on Jan. 28, 2025, U.S. patent application Ser. No. 18/930,965, filed on Oct. 29, 2024, and U.S. Provisional Patent Application Ser. No. 63/687,443, filed on Aug. 27, 2024, the entire contents of each of which are incorporated by reference herein.

FIELD

The present disclosure relates to devices, systems, and methods for sewing two halves of a baseball cover that are positioned in a plane, and being able to secure the two sewn halves around a core to form a baseball.

BACKGROUND

Baseball is the American pastime. A hidden element of the sport is just how many baseballs are used in a typical season. In Major League Baseball, any mark or discoloration on a ball is sufficient to require a replacement. A typical game uses one hundred or more balls. This rule is relaxed as the budget for individual games is reduced as one proceeds to lower levels of competition, but a ball is generally considered less and less usable as it becomes worn. Even college baseball games may use sixty or more balls per game. Only a small portion of the balls used become keepsakes or collectibles. Most of them are reused for training purposes until they become unfit for even that utility. Additionally, children across the world play baseball in formal and informal settings everyday.

Thus, a large number of baseballs must be provided for use by players of all ages and skill levels. Typically, all baseballs are sewn by hand. Artisans generally take from 15 minutes to 25 minutes to hand sew each baseball.

Further, while the covering of a baseball primarily dictates whether the baseball can still be used, the core of the baseball is often considered to be improved over time as it compresses with use. Essentially, the regular and repeated use of a ball over time further compresses and compacts the core such that it may improve upon its attributes or performance. Despite this, most baseballs are discarded when the cover becomes too worn or damaged. Some amount of craft exists that replaces baseball coverings, but such options are manual processes with considerable time and labor investment necessary for each restored ball. Ultimately, it is often not feasible for restored baseballs to be a considerable factor in sourcing effectively new baseballs, due to the inefficiency of the manual processes involved.

Accordingly, there is a need for baseballs to be sewn, or at least partially sewn by a machine to minimize the amount of human labor needed to construct or assemble the baseball.

SUMMARY

The present disclosure describes a system for assembling a baseball utilizing a machine or a device for at least part of the assembly. The machine takes two halves of baseball covers that are laying in a first plane and adds stitching to the covers while they are in the first plane. The stitched covers can then be assembled over a spherical core (new or used) to produce a baseball. The machine is computer programmed such that stitching (e.g., cross-stitching) of the baseball covers is consistent and efficient.

In addition to the machine, the disclosed system may also include tubing for placement around the perimeter of the baseball cover halves to facilitate assembly of the baseball, a film for supporting the baseball cover halves on the machine, and/or magnets to help maintain the position of the baseball cover halves on the film while the machine is applying stiches to the covers.

Associated methods of creating a baseball are also disclosed.

Provided in accordance with aspects of the present disclosure is a robotic device for sewing a ball. The device includes a platform, a first arm, a second arm, a first claw, a second claw, and a controller. The platform is configured to support a film for supporting a first half of a ball cover and a second half of a ball cover in a single plane. The first arm is positioned above the platform. The second arm is positioned below the platform. The first claw is supported by the first arm and is configured to releasably grasp a first needle. The second claw is supported by the second arm and is configured to release the first needle. The controller is disposed in communication with the first arm, the second arm, the first claw, and the second claw. The controller is configured to move the first arm, the second arm, the first claw, and the second claw such that the first needle follows a first needle path.

In an aspect of the present disclosure, the robotic device includes a third arm positioned above the platform, a fourth arm positioned below the platform, a third claw supported by the third arm, and a fourth claw supported by the fourth arm. This third claw is configured to releasably grasp a second needle, and the fourth arm is configured to releasably grasp the second needle.

In an aspect of the present disclosure, the controller is configured to move the third arm, the fourth arm, the third claw, and the fourth claw such that the second needle follows a second needle path.

In an aspect of the present disclosure, the first claw is rotatable relative to the first arm.

In an aspect of the present disclosure, the robotic device includes a first motor disposed in mechanical cooperation with the first claw. The first motor is configured to move a needle-grasping portion of the first claw relative to a body portion of the first claw.

In an aspect of the present disclosure, the robotic device includes a second motor disposed in mechanical cooperation with the first claw. The second motor is configured to move a second needle-grasping portion of the first claw relative to the body portion of the first claw.

In an aspect of the present disclosure, the body portion of the first claw includes a first half and a second half. The first half of the body portion of the claw is movable relative to the second half of the body portion of the claw.

In an aspect of the present disclosure, the first needle path includes portions of the first half of the ball cover and portions the second half of the ball cover, and the second needle path includes portions of the first half of the ball cover and portions the second half of the ball cover.

Provided in accordance with aspects of the present disclosure is a system for sewing a baseball including a robotic device, a first tube, and a second tube. The robotic device includes a platform, a first arm, a second arm, a third arm, a fourth arm, a first claw, a second claw, a third claw, a fourth claw, and a controller. The platform is configured to support a film for supporting a first half of a ball cover and a second half of a ball cover in a single plane. The first arm is positioned above the platform. The second arm is positioned below the platform. The third arm is positioned above the platform. The fourth arm is positioned below the platform. The first claw is engaged with the first arm and is configured to releasably grasp a first needle. The second claw is engaged with the second arm and is configured to releasably grasp the first needle. The third claw is engaged with the third arm and is configured to releasably grasp a second needle. The fourth claw is engaged with the fourth arm and is configured to releasably grasp the second needle. The controller is disposed in communication with the first arm, the second arm, the third arm, the fourth arm, the first claw, the second claw, the third claw, and the fourth claw. The controller configured to move the first needle along a first needle path, and is configured to move the second needle along a second needle path. The first tube is configured for positioning along a perimeter of the first half of the ball cover. The second tube is configured for positioning along a perimeter of the second half of the ball cover.

In an aspect of the present disclosure, the first tube and the second tube each define a C-shaped cross-section.

In an aspect of the present disclosure, the first tube and the second tube are made from at least one of silicone or thermoplastic elastomer (TPE).

In an aspect of the present disclosure, the first claw of the robotic device is rotatable relative to the first arm.

In an aspect of the present disclosure, the robotic device includes a first motor disposed in mechanical cooperation with the first claw. The first motor is configured to move a needle-grasping portion of the first claw relative to a body portion of the first claw.

Provided in accordance with aspects of the present disclosure is a method of sewing a baseball. The method includes supporting a film on a platform, supporting a first half of a baseball cover on the film such that the first half of the baseball cover is on a first plane, supporting a second half of a baseball cover on the film such that the second half of the baseball cover is on the first plane, moving a first thread along a first path, wherein the first path includes a plurality of holes in the first half of the baseball cover and a plurality of holes in the second half of the baseball cover, and moving a second thread along a second path, wherein the second path includes a plurality of holes in the first half of the baseball cover and a plurality of holes in the second half of the baseball cover.

In an aspect of the present disclosure, the method includes removing the film with the first half of the baseball cover and the second half of the baseball cover from the platform.

In an aspect of the present disclosure, the method includes positioning the first half of the baseball cover and the second half of the baseball cover adjacent a spherical core.

In an aspect of the present disclosure, the method includes pulling the first thread and the second thread to secure the spherical core within the first half of the baseball cover and the second half of the baseball cover.

In an aspect of the present disclosure, the method includes positioning a first tube along a perimeter of the first half of the baseball cover, and positioning a second tube along a perimeter of the second half of the baseball cover.

In an aspect of the present disclosure, moving the first thread along the first path includes moving the first thread around a portion of the first tube, and moving the second thread along the second path includes moving the second thread around a portion of the second tube.

In an aspect of the present disclosure, the method includes temporarily securing the first half of the baseball cover to the film using magnets, and temporarily securing the second half of the baseball cover to the film using magnets.

BRIEF DESCRIPTION OF THE DRAWINGS

Various aspects and features of the present disclosure are described hereinbelow with reference to the drawings wherein.

DETAILED DESCRIPTION

Figure 1:
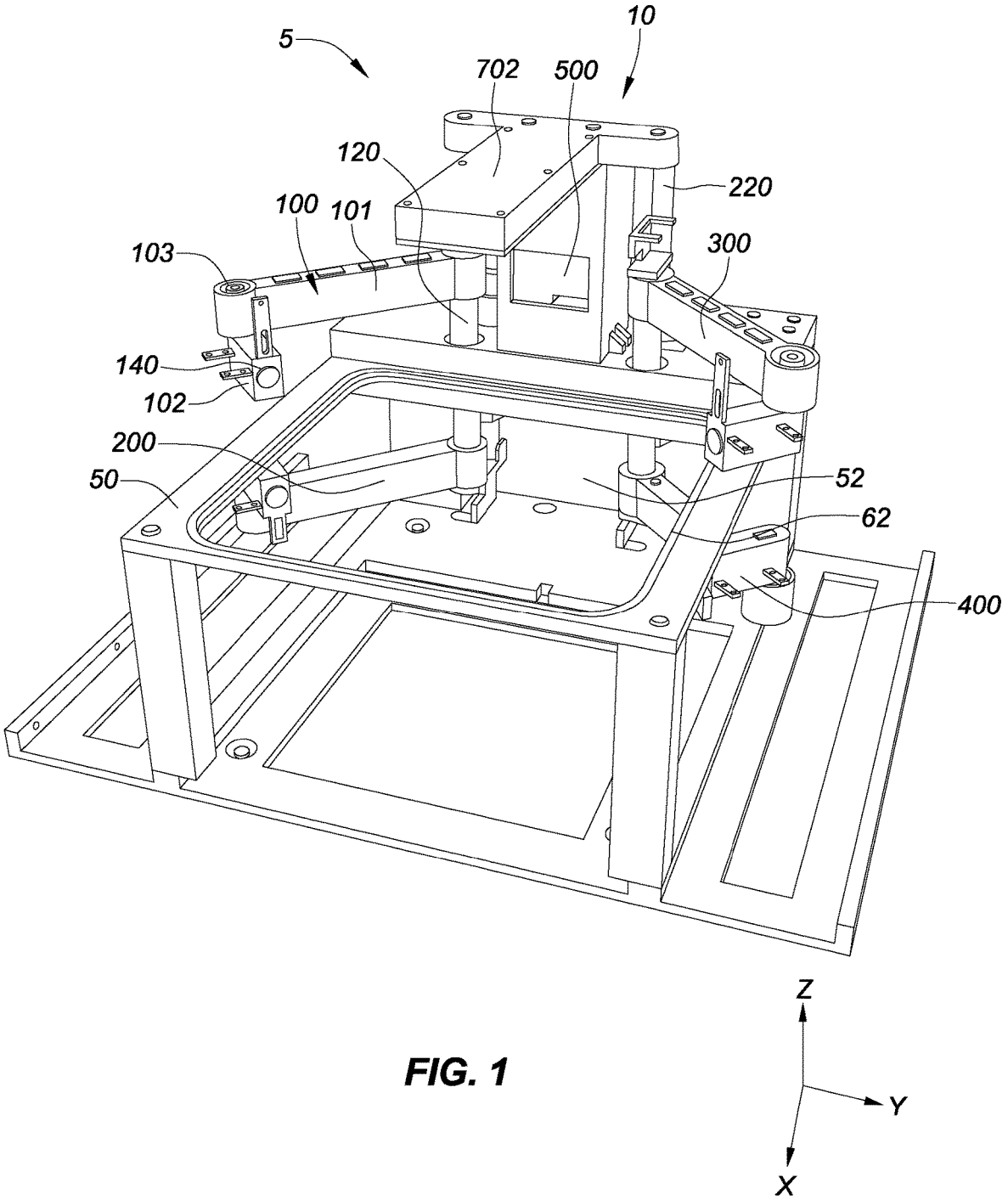
FIG. 1 is a perspective view of a robotic sewing machine according to aspects of the present disclosure.

Descriptions of technical features or aspects of an exemplary configuration of the disclosure should typically be considered as available and applicable to other similar features or aspects in another exemplary configuration of the disclosure. Accordingly, technical features described herein according to one exemplary configuration of the disclosure may be applicable to other exemplary configurations of the disclosure, and thus duplicative descriptions may be omitted herein.

Exemplary configurations of the disclosure will be described more fully below (e.g., with reference to the accompanying drawings). Like reference numerals may refer to like elements throughout the specification and drawings.

The devices, systems, and methods described herein are for sewing two halves of a baseball cover that are positioned in a plane, and being able to secure the two sewn halves around a core to form a baseball. The devices, systems, and methods are configured to drastically shorten the amount of time it takes to sew a baseball around a spherical core. Further, the devices, systems, and methods described herein are usable when sewing the baseball cover around a new core or around a used core.

While the present disclosure describes devices, systems, and methods of sewing a baseball, the same or similar devices, systems, and methods are also usable to sew other types of balls, such as softballs, for example. Thus, as used herein, the term "baseball" includes baseballs, softballs, stitched balls, and other balls where two pieces of material are sewn together and secured over a spherical core.

According to aspects of the present disclosure, a system 5 for sewing a ball is disclosed. With reference to FIGS. 1-4, a robotic sewing device 10 of the system 5 includes a platform 50, a first arm 100, a second arm 200, a third arm 300, a fourth arm 400, and a controller 500. The platform 50 is configured to support a film 60 for supporting a first half of a baseball cover 610, and a second half of a baseball cover 620 (see FIG. 9). Generally, the controller 500 communicates with the first arm 100, the second arm 200, the third arm 300, and the fourth arm 400, and is configured to move the arms 100, 200, 300, 400 along a particular pattern or needle path to help ensure that the first half of the baseball cover 610 and the second half of the baseball cover 620 are properly sewn such that they can be positioned about a spherical core to form a baseball. The arms may be used in various combinations to handle individual and separate strands of threads (e.g., simultaneously). For example, arms 100 and 200 may be employed to stitch one strand of thread while arms 300 and 400 may be employed to stitch a second and separate strand of thread. Additional arms with similar functionality may be employed (e.g., an 8 arm arrangement) to stitch multiple patterns/paths simultaneously and to increase the overall rate of speed of the stitching procedure.

As shown in FIG. 1, the first arm 100 and the third arm 300 are positioned above the platform 50, and the second arm 200 and the fourth arm 400 are positioned below the platform 50. Each arm 100, 200, 300, 400 is movable relative to the platform 50 along the x-axis and the y-axis, and, optionally the z-axis. More particularly, the first arm 100 and the second arm 200 are each movable or pivotable about a first shaft 120 (i.e., movable in the x- and y-axes), and may each be movable along the first shaft 120 (i.e., movable in the z-axis); the third arm 300 and the fourth arm 400 are each movable or pivotable about a second shaft 220 (i.e., movable in the x- and y-axes), and may each be movable along the first shaft 220 (i.e., movable in the z-axis). Additionally, each of the first arm 100, the second arm 200, the third arm 300, and the fourth arm 400 includes a first portion 101, a second portion 102, and a pivot 103 therebetween (for clarity, only the first arm 100 has these portions labelled in FIG. 1). The second portion 102 is configured to pivot relative to the first portion 101 about the pivot 103. The controller 500 is configured to control this movement of each of the arms.

Figure 5:
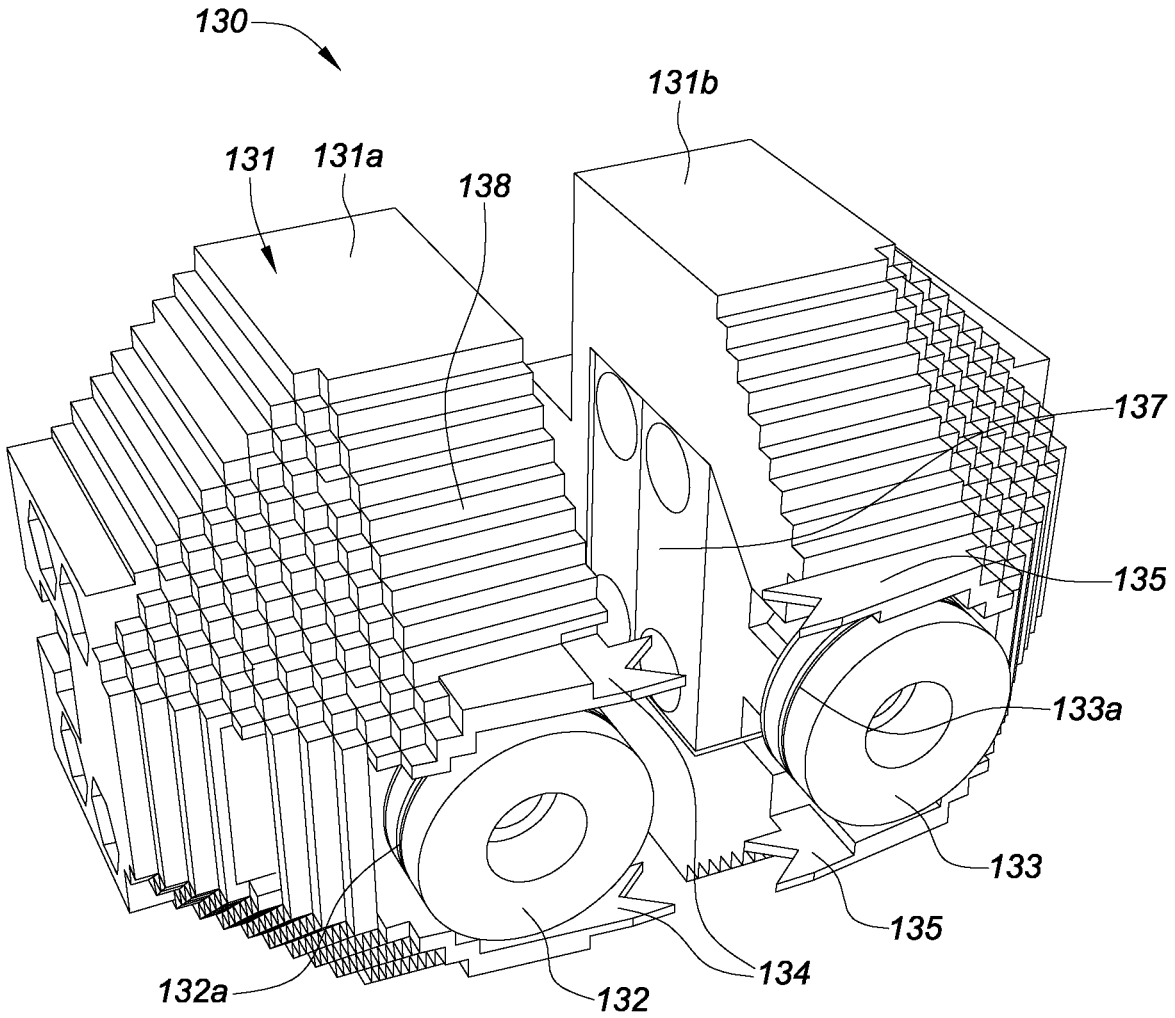
FIG. 5 is a perspective view of a claw of the robotic sewing machine of FIG. 1.

Further, each of the first arm 100, the second arm 200, the third arm 300, and the fourth arm 400 supports a first claw 130, a second claw, a third claw, and a fourth claw, respectively. For clarity and brevity, only the first claw 130 is shown in FIG. 5 and described in detail; the second claw, the third claw, and the fourth claw are identical or substantially identical to the first claw 130. Each arm 100, 200, 300, 400 includes a respective claw holder (only claw holder 140 is labelled in FIG. 1) for supporting the respective claw.

With particular regard to FIG. 5, the first claw 130 is configured to grip a needle, to advance and retract the needle, and to rotate the needle. The first claw 130 includes a base 131 having a first section 131*a* and a second section 131*b*. The base 131 also includes a stepped portion 138 that is configured to help maintain wound thread in a non-tangled orientation.

The first claw 130 also includes a first wheel or needle-grasping portion 132 and a second wheel or needle-grasping portion 133, at least one of which is moveable relative to the other to grasp a needle therebetween. Further, each needle-grasping portion 132, 133 is rotatable about a central axis extending therethrough relative to the first section 131*a* and the second section 131*b* of the base 131, respectively. Each needle-grasping portion 132, 133 is shown including a respective needle channel 132*a*, 133*a* to help further control the precise position of the needle held and therebetween.

Each section 131*a*, 131*b* of the first claw 130 includes a pair of needle guides 134, 135, respectively. One of the needle guides 134 is positioned above the first needle-grasping portion 132, and one of the needle guides 134 is positioned below the first needle-grasping portion 132. Likewise, one of the needle guides 135 is positioned above the second needle-grasping portion 133, and one of the needle guides 135 is positioned below the second needle-grasping portion 133. The needle guides 134, 135 are depicted as including a triangular cut-away portion, which is configured to help maintain the grasped needle in an intended orientation.

The first claw 130 also includes a first servomotor (obscured from view in FIG. 5) and a second servomotor 137, which are used for precise control of linear and rotational movement of the needle gripped between the first needle-grasping portion 132 and the second needle-grasping portion 133. More particularly, the first servomotor and the second servomotor 137 are used to move the needle linear relative to the base 131 of the first claw 130 (e.g., by rotating the needle-grasping portions 132, 133 at the same rate and direction as each other), and rotationally relative to the base 131 (e.g., by rotating the needle-grasping portions 132, 133 at different rates/directions from each other).

The controller 500 employs signals to the first servomotor and the second servomotor 137 to precisely control the movement of the needle. Additionally, the first arm 100 includes an electrical slip joint to allow or facilitate the transfer of power and/or data between the first arm 100 and the first claw 130.

Figure 3:
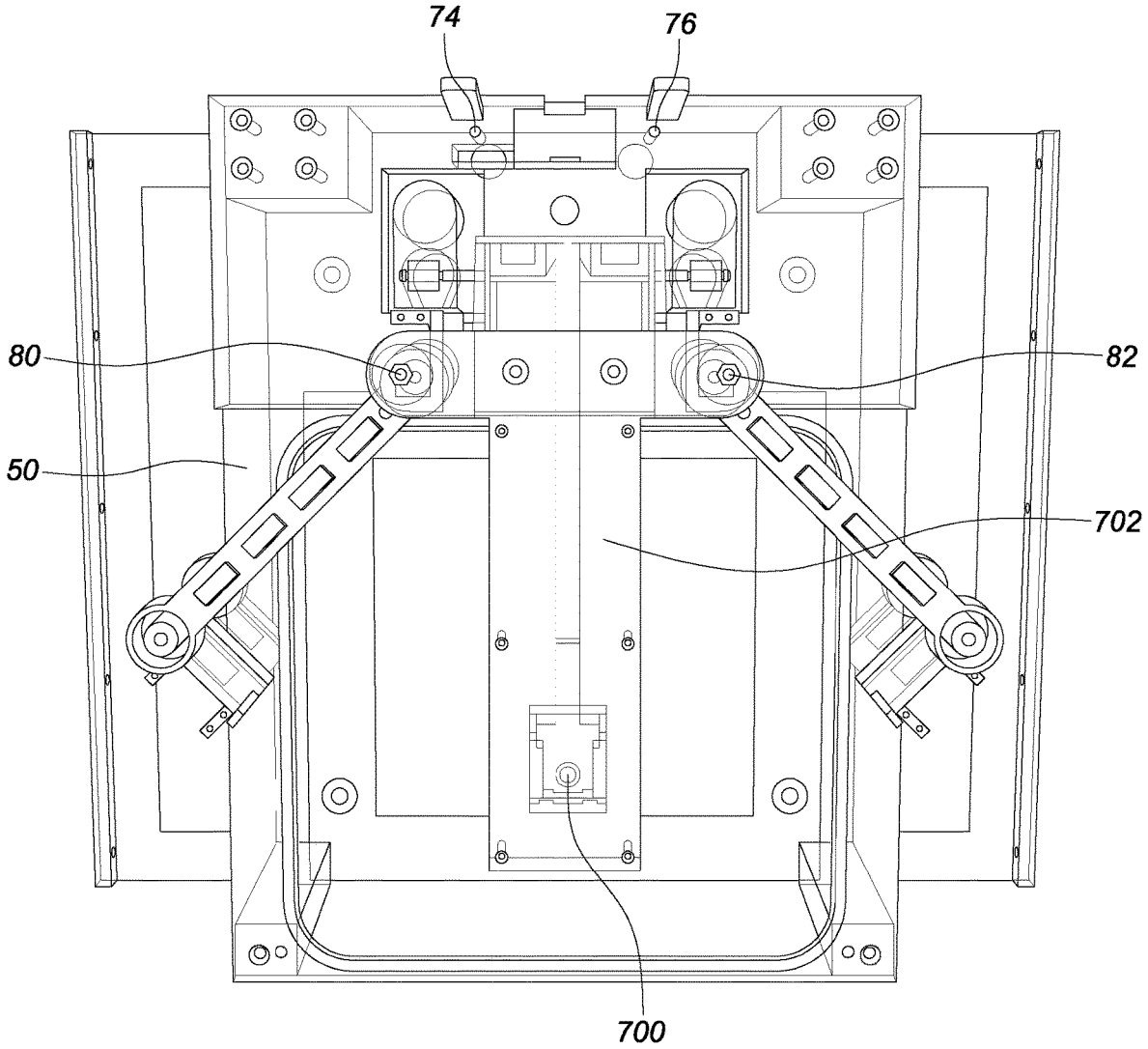
FIG. 3 is a top, X-ray view of the robotic sewing machine of FIG. 1.

As shown in FIG. 3, the robotic sewing device 10 also includes an optical sensor 700. The optical sensor 700 is housed in a beam 702 above the platform 50. The optical sensor 700 is disposed in communication with the controller 500 to help determine the precise path of the needles. Additionally, a light may be positioned below the platform 50, and generally facing the optical sensor 700 to help the optical sensor precisely locate holes in the first half of the baseball cover 610 and the second half of the baseball cover 620, as discussed in further detail below.

Referring back to FIG. 1, the controller 500 is shown positioned between the first arm 100 and the third arm 300. The controller 500 can include touch-screen controls, and is in communication (wired and/or wireless) with the first arm 100, the second arm 200, the third arm 300, the fourth arm 400, the first claw 130, the second claw 230, the third claw 330, the fourth claw 430, the first servomotor and the second servomotor 137 of each claw, and the optical sensor 700. The controller 500 includes software instructing the various components to sew particular patterns in the first half of the baseball cover 610, and the second half of the baseball cover 620 that are positioned on the film 60 that is supported by the platform 50.

Additionally, the platform 50 defines an opening 52, which is at least partially surrounded by a film loop 62 for temporarily securing the film 60 to the platform 50. The film 60 is configured support the first half of the baseball cover 610 and the second half of the baseball cover 620, is configured to be pierced multiple times by needles and thread, and can be translucent or transparent to allow light to pass through holes in the first half of the baseball cover 610 and the second half of the baseball cover 620 to be seen by the optical sensor 700.

Figure 2:
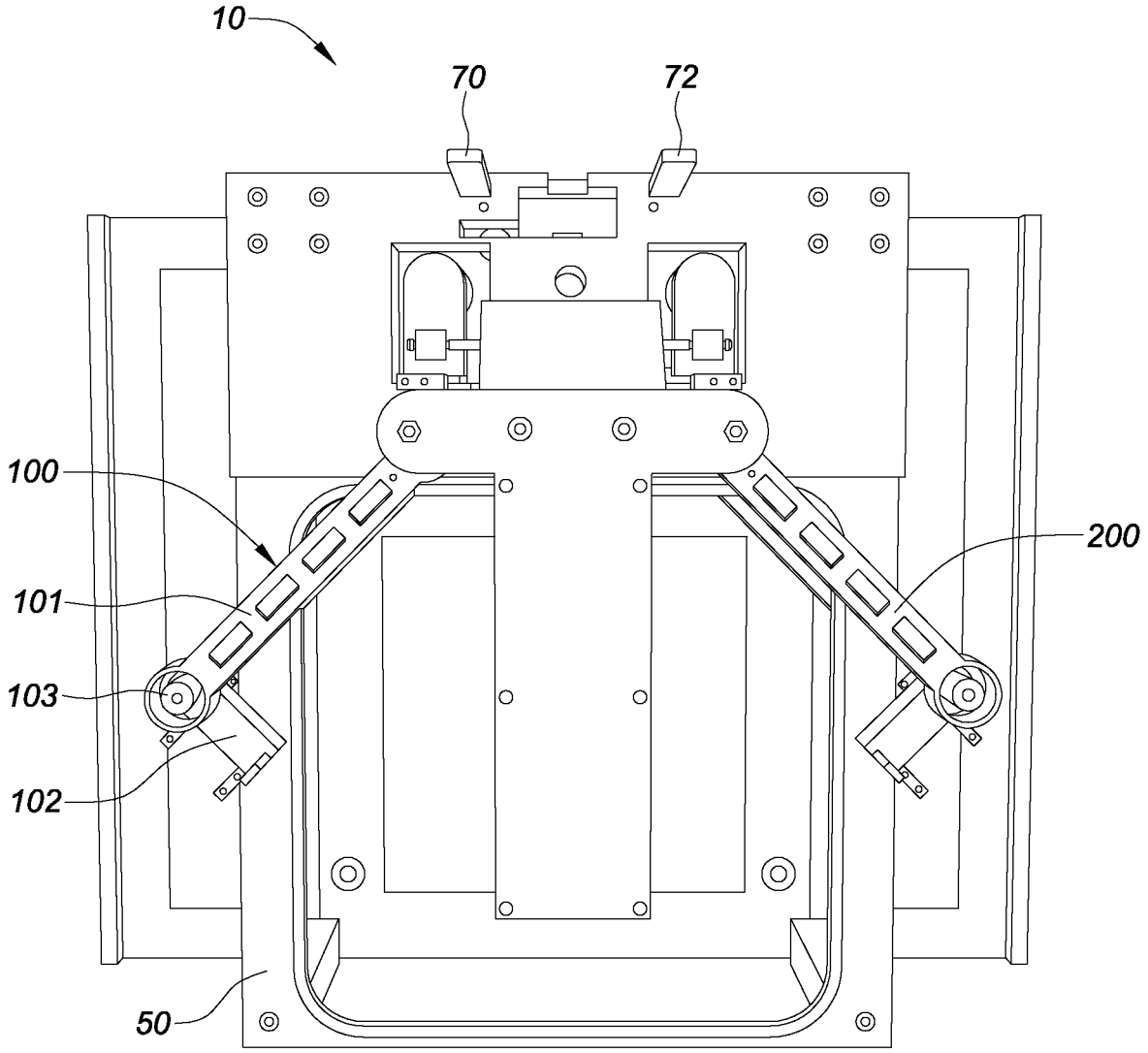
FIG. 2 is a top view of the robotic sewing machine of FIG. 1.
Figure 4:
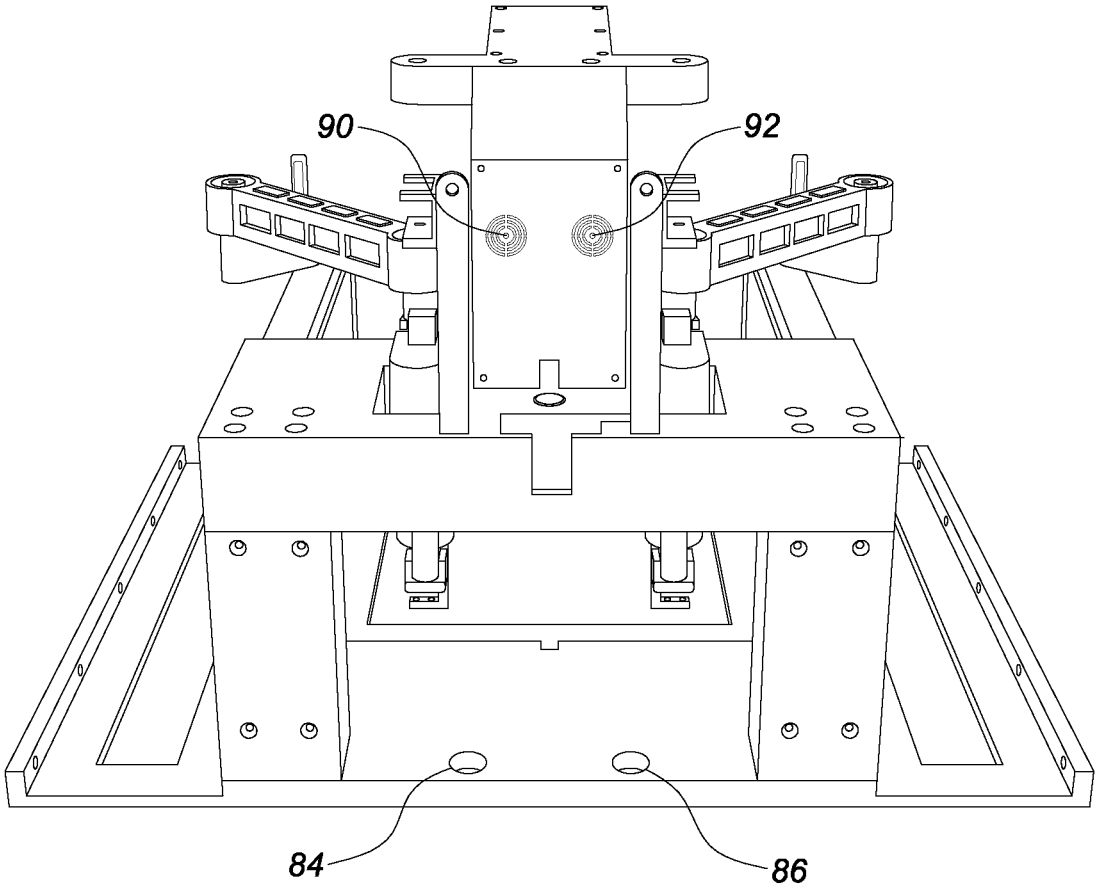
FIG. 4 is a rear, perspective view of the robotic sewing machine of FIG. 1.

With particular reference to FIGS. 2 and 3, the robotic sewing device 10 includes a first thread guide 70, a second thread guide 72, a first hole thread guide 74, a second hole thread guide 76, a first thread securing location 80, and a second thread securing location 82. These features are configured to guide and direct thread between various components of the robotic sewing device 10. Referring to FIG. 4, a first bobbin holder 84, and a second bobbin holder 86 are shown, and are each configured to hold a bobbin of thread. A pair of speakers 90, 92 is also shown in FIG. 4, which are configured to emit sound from the controller 500, such as to provide feedback or instructions to a user of the robotic sewing device 10.

Figure 6:
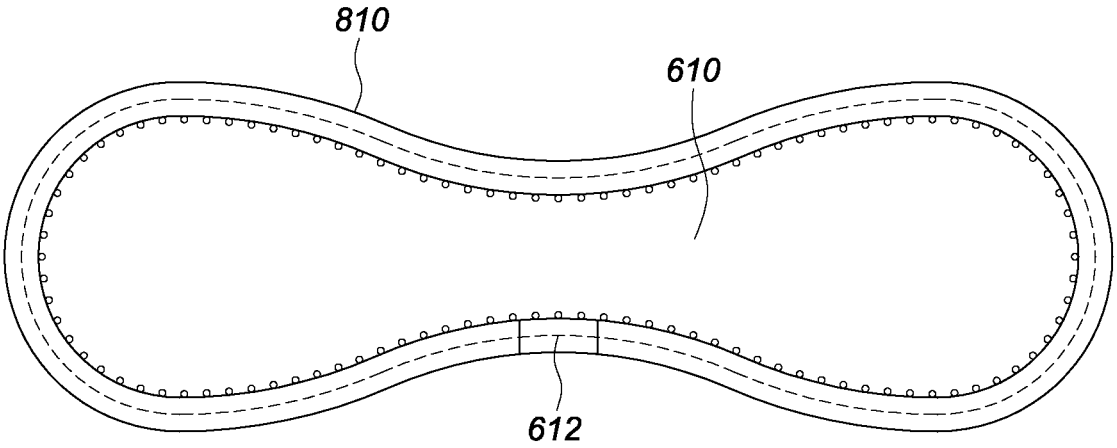
FIG. 6 is a top view of a first half of a baseball cover including a first tube positioned along a perimeter of the first half of the baseball cover for use with the robotic sewing machine of FIG. 1.
Figure 7:
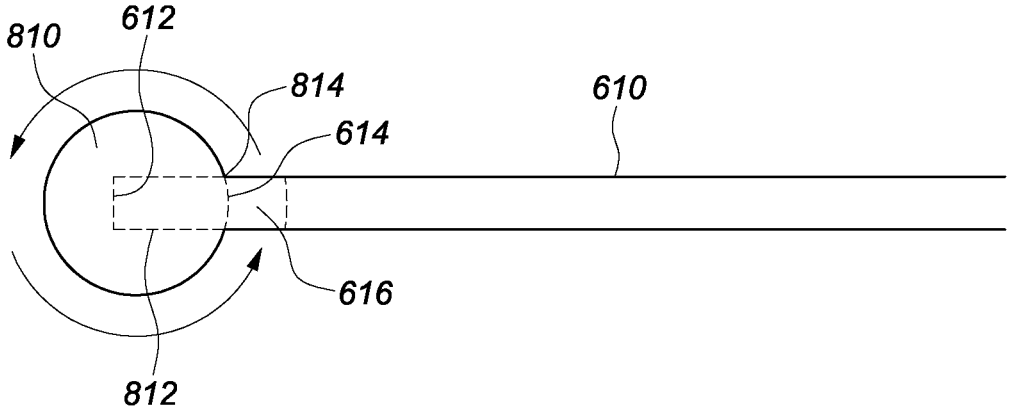
FIG. 7 is a cross-sectional view of the first tube of FIG. 6 positioned along the perimeter of the first half of the baseball cover according to aspects of the present disclosure.
Figure 8:
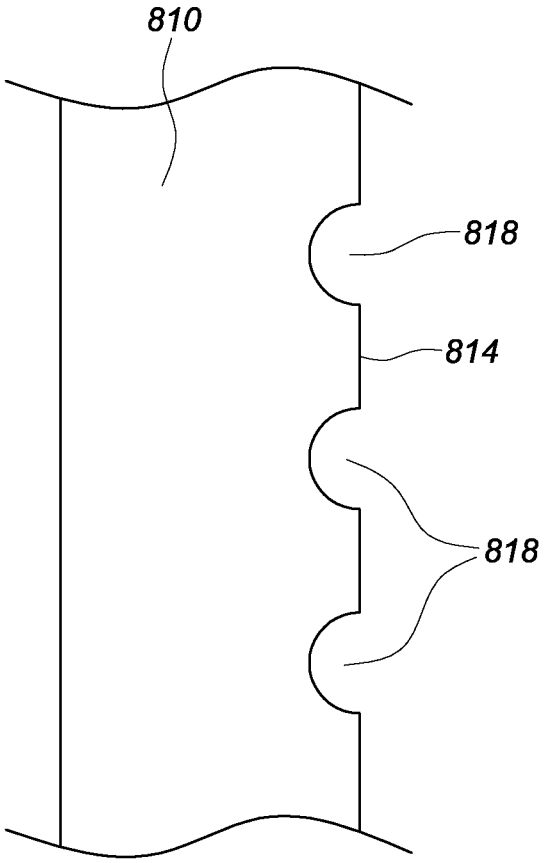
FIG. 8 is a top view of a portion of the first tube of FIG. 6 including guide channels according to aspects of the present disclosure.

Referring now to FIGS. 6-8, the system 5 includes a first tube 810 and a second tube 820. The first tube 810 is configured for positioning along a perimeter of the first half of the baseball cover 610, and the second tube 820 is configured for positioning along a perimeter of the second half of the baseball cover 620. The first tube 810 and the second tube 820 are identical or substantially identical. For clarity and brevity, only details of the first tube 810 are described herein.

The first tube 810 is generally elongated and is pre-curved or able to be curved along a perimeter of the first half of the baseball cover 610. The first tube 810 is configured to fit snugly (and removably) around the perimeter of the first half of the baseball cover 610 (e.g., in a friction-fit arrangement) prior to the first half of the baseball cover 610 and the second half of the baseball cover 620 being stitched together. In aspects, the first tube 810 is made from a flexible, semi-rigid, or resilient material such as silicone or a thermoplastic elastomer, for instance.

The first tube 810 is configured to protect an edge 612 of the first half of the baseball cover 610 during the stitching process, reduce stitch resistance, and increase seam consistency when the thread is pulled tight around the spherical core.

With particular reference to FIG. 7, the first tube 810 defines a C-shaped cross-section and includes a slot, groove, or channel 812 therein. The slot 812 is sized and shaped to slide over the edge 612 of the first half of the baseball cover 610. Additionally, in the aspect illustrated in FIG. 7, the size of the slot 812 is configured such that an inner edge 814 of the first tube 810 aligns or substantially aligns with an outer edge 614 of a hole 616 defined by the first half of the baseball cover 610.

With continued reference to FIG. 7, while the inclusion of the first tube 810 on the first half of the baseball cover 610 slightly raises the edge 612 above the plane of the film 60 (not shown in FIG. 7), for the purposes of this disclosure, the first half of the baseball cover 610 and the second half of the baseball cover 620 are still considered to be within a single plane when the first tube 810 and the second tube 820 are respectively engaged therewith.

Referring now to FIG. 8, a top view of a portion of the first tube 810 according to an aspect of the present disclosure is shown. Here, the first tube 810 defines a plurality of guide channels 818. The guide channels 818 are positioned the inner edge 814 of the first tube 810 and are configured to align or substantially align with the holes 616 defined by the first half of the baseball cover 610. More particularly, in disclosed aspects, each guide channel 818 of the first tube 810 aligns or substantially aligns with a corresponding hole 616 of the first half of the baseball cover 610. The guide channels 818 are configured to help direct or guide the precise position of the needle held by the robotic sewing device 10 to help ensure the needle efficiently enters each hole 616, such as at or near the center of the hole 616. For instance, if the needle becomes slightly askew, contact between the needle and the portion of the first tube 810 adjacent a particular guide channel 818 can help reposition or redirect the needle towards the center of the respective hole 616.

Figure 9:
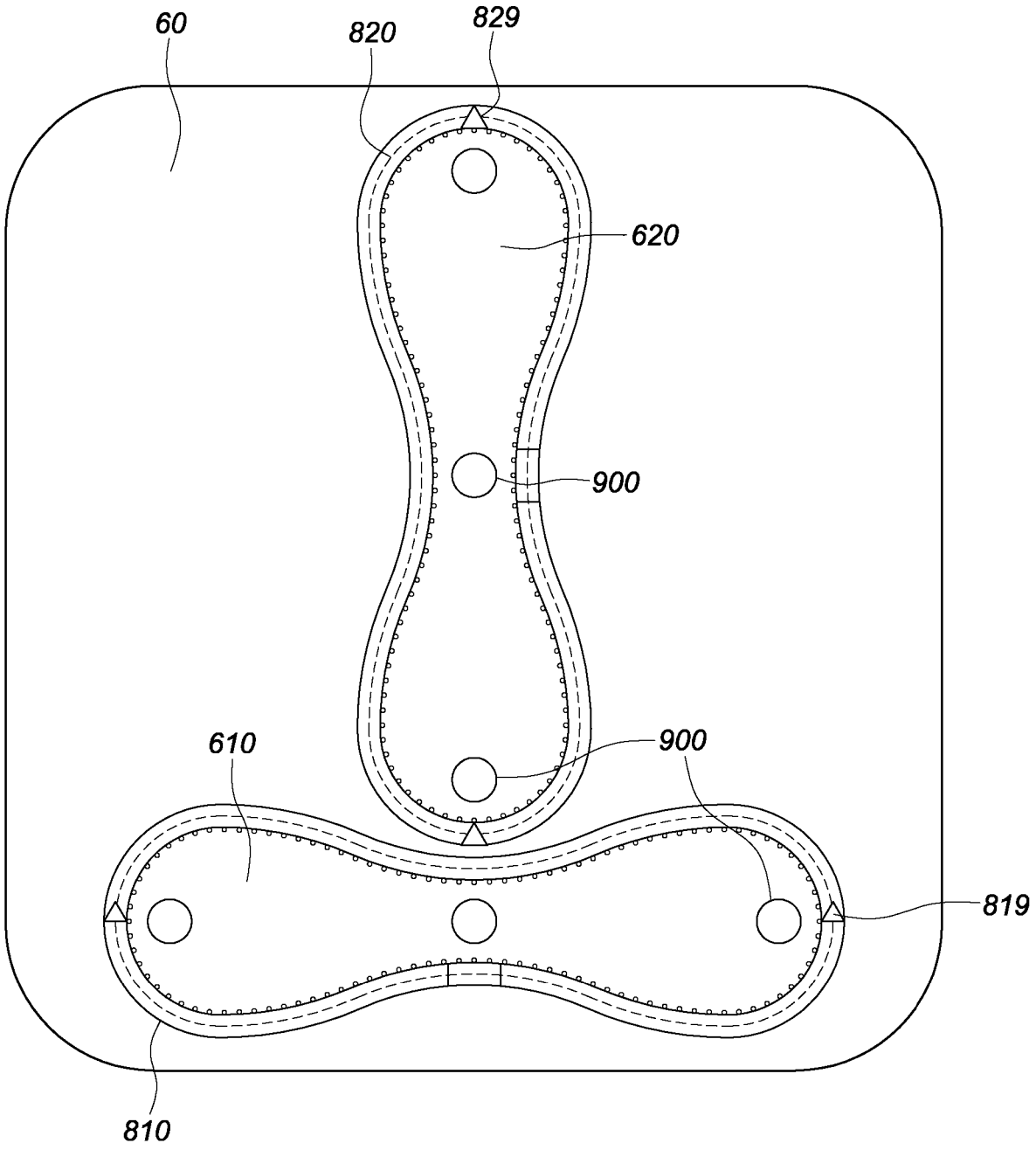
FIG. 9 is a top view of the first half of the baseball cover and a second half of the baseball cover positioned on a film for use with the robotic sewing machine of FIG. 1 according to aspects of the present disclosure.

With reference to FIG. 9, the first half of the baseball cover 610 and the second half of the baseball cover 620 are shown with the first tube 810 and the second tube 820, respectively engaged therewith. The first half of the baseball cover 610 and the second half of the baseball cover 620 are positioned on the film 60 and are in a single plane (for the purposes of this application). In the illustrated aspect, the first tube 810 and the second tube 820 each include identifiers or reference marks 819, 829, respectively. The identifiers 819, 829 are configured to help the robotic sewing device 10 gain spatial orientation with respect to the first half of the baseball cover 610 and the second half of the baseball cover 620. While the identifiers 819, 829 are shown having a particular shape and in particular locations along the first tube 810 and the second tube 820, the identifiers 819, 829 can be other shapes or take on other forms, and can be positioned at any location along the first tube 810 and/or the second tube 820. Additionally, the first tube 810 and/or the second tube 820 can include more or fewer identifiers 819, 829 than the amount illustrated.

With continued reference to FIG. 9, a plurality of magnets 900 is shown. The magnets 900 are positioned on each of the first half of the baseball cover 610 and the second half of the baseball cover 620. Each magnet 900 is configured to engage a corresponding magnet positioned beneath the film 60, such that each of first half of the baseball cover 610 and the second half of the baseball cover 620 is positioned between at least one pair of magnets 900. The magnets 900 help maintain the position of the first half of the baseball cover 610 and the second half of the baseball cover 620 relative to the film 60 while the first half of the baseball cover 610 and the second half of the baseball cover 620 are being stitched by the robotic sewing device 10. Any type of suitable magnet can be utilized, such as neodymium magnets or other rare earth magnets, for example.

To use the system 5 and the robotic sewing machine 10, a user temporarily secures the film 60 to the platform 50 of the robotic sewing machine 10 utilizing the film loop 62, and then positions the first half of the baseball cover 610 and the second half of the baseball cover 620 on the film 60. In aspects, the first tube 810 and the second tube 820 are positioned around the perimeter of the first half of the baseball cover 610 and the second half of the baseball cover 620, respectively, prior to their positioning on the film 60. Optionally, the magnets 900 are used to temporarily secure the first half of the baseball cover 610 and the second half of the baseball cover 620 to the film 60.

To load the thread onto a needle, a user can position a needle such that the needle is held by the first claw 130 and then insert thread through the eye of the needle. Next, the thread is loaded onto the first claw 130 by rotating the first claw 130 relative to the first arm 100 about an axis extending through the first claw 130. This rotation of the first claw 130 causes the thread to wrap around the stepped portion 138 of the first claw 130, for instance. The same process is followed to load thread onto a different claw, such as the third claw.

After the first half of the baseball cover 610 and the second half of the baseball cover 620 are positioned on the film 60, and after the thread has been loaded onto one or more of the claws (e.g., the first claw 130 and the third claw), the controller 500 sends signals to the various components of the system 5 to move the first needle (initially held by the first claw 130, for instance) and the thread engaged therewith through a first hole 616*a* in the first half of the baseball 610, through the film 60, and between the first and second needle-grasping portions of the second claw 230 beneath the platform 50. Next, the second claw, and its associated first servomotor and second servomotor, grasp the needle and move the needle (and associated thread) away from the first hole 616*a*, rotate the needle with respect to the platform 50 by rotating the second claw relative to the second arm 200 (such that the point of the needle is facing the film 60), move the needle laterally such that the needle aligns with a first hole 626*a* in the second half of the baseball cover 620, and move the needle through the film 60 and through the first hole 626*a* in the second half of the baseball cover 620 such that the needle can be grasped by the first and second needle-grasping portions 132, 133 of the first claw 130. This process is repeated and generally follows the first path "A" shown in FIG. 10. Likewise, the second claw and the fourth claw cooperate and follow path "B," until each hole of the first half of the baseball cover 610 and the second half of the baseball cover 620 is loosely threaded.

Figure 10:
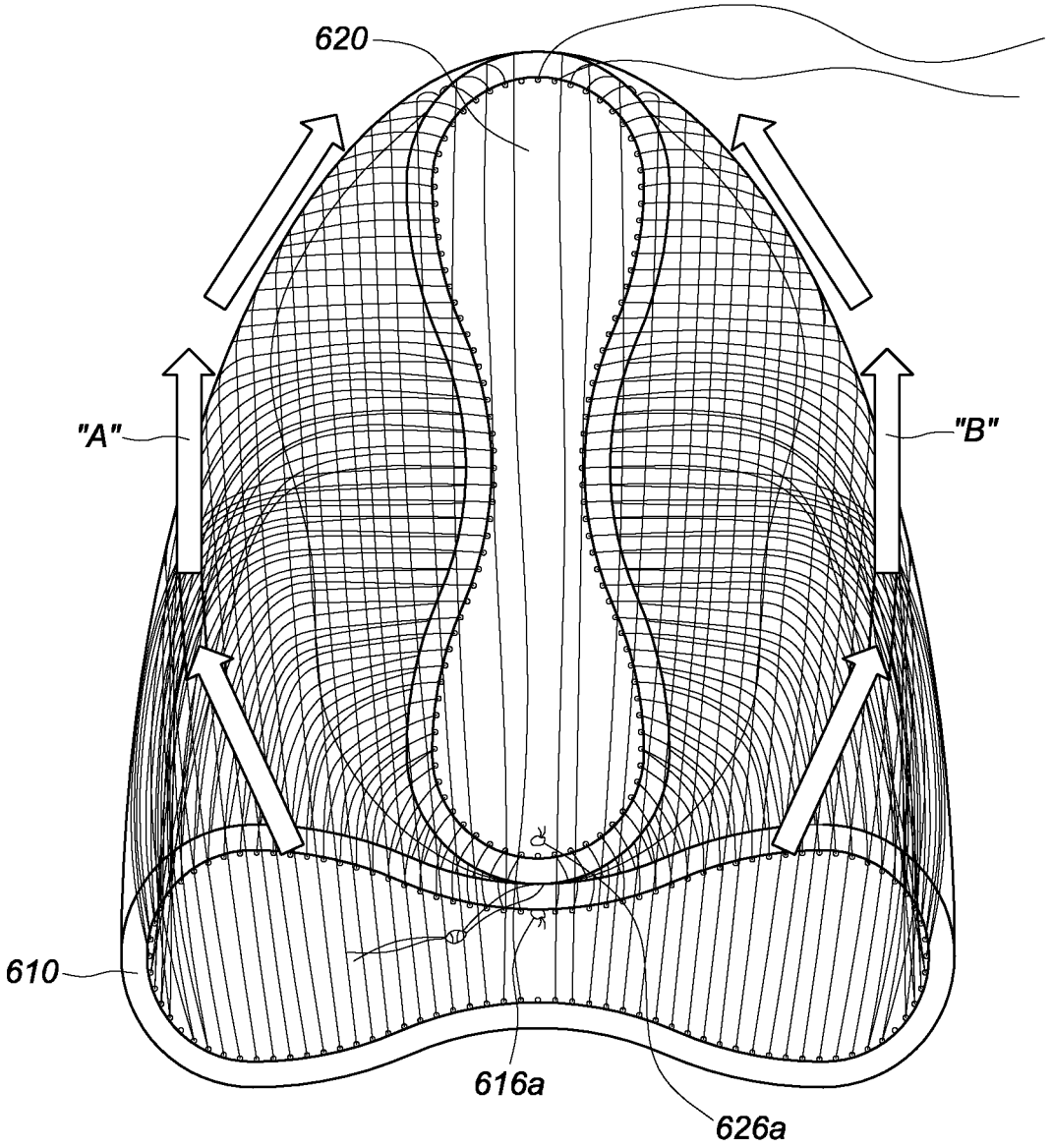
FIG. 10 is a top view of the two halves of the baseball cover after being sewn by the robotic sewing machine of FIG. 1.

After the loose threading is complete (as shown in FIG. 10), the magnets 900 (if utilized) are removed, and the first half of the baseball cover 610, the second half of the baseball cover 620, and the film 60 are removed from the platform 50. Next, the film 60 is removed from the covers 610, 620, and the first half of the baseball cover 610 and the second half of the baseball cover 620 are positioned adjacent a spherical core such that the spherical core is loosely encased between the first half of the baseball cover 610 and the second half of the baseball cover 620. Then, the thread is tensioned either by a human or a machine (e.g., a robotic pull tensioner). While the thread is being tensioned, the first tube 810 and the second tube 820 provide an external pressure around the perimeter of the first half of the baseball cover 610 and the second half of the baseball cover 620, which helps to reduce seam resistance, helps to keep maintain seam consistency during the pulling process, and/or helps alleviate over-stressing of certain parts of the thread and/or portions of the covers 610, 620.

Once the first half of the baseball cover 610 and the second half of the baseball cover 620 are pulled fairly taut around the spherical core, the first tube 810 and the second tube 820 are removed from the covers 610, 620, excess thread is cut and removed, and a human or machine applies the final tensioning of the remaining thread, resulting in a fully threaded baseball.

Referring particularly to FIG. 10, the system 5 and robotic sewing device 10 are configured to create a stitch pattern in baseball covers 610 and 620 with the baseball covers 610 and 620 arranged in 2-dimensions (2-D) (e.g., in a flat arrangement), and that stitch pattern is configured to be later tensioned into a 3-dimensional (3-D) pattern by tightening the threads to couple covers 610 and 620 about a baseball core. That is, the stitch pattern is configured to be robotically generated in a 2-D pattern that is later serviceable in a 3-D context when the covers 610 and 620 are secured about a baseball core. This simplifies the needed arrangement of the system 5 and robotic sewing device 10 to allow for efficient and cost-effective baseball stitching through the use of robotic equipment and with minimal or no manual human stitching.

The described method of stitching a baseball cover in two dimensions, followed by tightening the stitched cover around a spherical baseball core, demonstrates an unexpected technical advantage. Conventionally, stitch patterns for baseballs were understood as being inherently three-dimensional, requiring manual placement and tightening by skilled human operators. By contrast, the disclosed process begins with a two-dimensional stitch configuration, which is later drawn into three-dimensional conformity when applied to the core. This shows that a stitch pattern can function effectively in both a planar (two-dimensional) state for ease of manipulation by automated systems, and in a spherical (three-dimensional) state for conforming tightly to the ball core. This is an unexpected technical result that has allowed for an efficient system 5 and device 10 to be realized.

The disclosed method further satisfies a long-felt but unmet need in the sporting goods industry, namely, the ability to automate the stitching of baseball covers. Historically, baseball stitching has required highly skilled human labor, due in part to the complexity of working with three-dimensional curved surfaces. This reliance on manual processes has imposed cost, scalability, and consistency limitations on baseball manufacturing. By enabling stitching to occur in a two-dimensional configuration—well-suited to robotic or automated sewing equipment—and then tightening the stitched cover onto a spherical core, the present inventive concept removes (or substantially reduces) the need for human-only labor. The result is a significant advancement in the ability to employ robotics and automation in baseball manufacture, addressing a long-standing problem that persisted despite substantial industry demand for a solution.

As an example of increased speed and efficiency, the device and system described herein may include additional arms (with the same functionality as the other arms described herein) to stitch multiple baseball covers simultaneously, such as multiple baseball covers arranged on a single film. Additionally, multiple devices may be arranged in a mass production style assembly line and the operation and monitoring of such machines may be integrated into a single process, such as an optically monitored process.

It will be understood that various modifications may be made to the aspects and features disclosed herein. Therefore, the above description should not be construed as limiting, but merely as exemplifications of various aspects and features. Those skilled in the art will envision other modifications within the scope and spirit of the claims appended thereto.

What is claimed is:

1. A system for sewing a baseball, the system comprising:

a robotic device for sewing a ball, the robotic device comprising:

a platform configured to support a film for supporting a first half of a ball cover and a second half of a ball cover in a single plane;

a first arm positioned above the platform;

a second arm positioned below the platform;

a third arm positioned above the platform;

a fourth arm positioned below the platform;

a first claw engaged with the first arm and configured to releasably grasp a first needle;

a second claw engaged with the second arm and configured to releasably grasp the first needle;

a third claw engaged with the third arm and configured to releasably grasp a second needle;

a fourth claw engaged with the fourth arm and configured to releasably grasp the second needle; and a controller disposed in communication with the first arm, the second arm, the third arm, the fourth arm, the first claw, the second claw, the third claw, and the fourth claw, the controller configured to move the first needle along a first needle path, the controller configured to move the second needle along a second needle path;

a first tube configured for positioning along a perimeter of the first half of the ball cover; and a second tube configured for positioning along a perimeter of the second half of the ball cover.

2. The system according to claim 1, wherein the first tube and the second tube each define a C-shaped cross-section.

3. The system according to claim 1, wherein the first tube and the second tube are made from at least one of silicone or thermoplastic elastomer (TPE).

4. The system according to claim 1, wherein the first claw of the robotic device is rotatable relative to the first arm.

5. The system according to claim 4, wherein the robotic device includes a first motor disposed in mechanical cooperation with the first claw, the first motor is configured to move a needle-grasping portion of the first claw relative to a body portion of the first claw.

6. A method of sewing a baseball, the method comprising:

supporting a film on a platform;

supporting a first half of a baseball cover on the film such that the first half of the baseball cover is on a first plane;

supporting a second half of a baseball cover on the film such that the second half of the baseball cover is on the first plane;

moving a first thread along a first path, wherein the first path includes a plurality of holes in the first half of the baseball cover and a plurality of holes in the second half of the baseball cover; and moving a second thread along a second path, wherein the second path includes a plurality of holes in the first half of the baseball cover and a plurality of holes in the second half of the baseball cover.

7. The method according to claim 6, further comprising removing the film with the first half of the baseball cover and the second half of the baseball cover from the platform.

8. The method according to claim 7, further comprising positioning the first half of the baseball cover and the second half of the baseball cover adjacent a spherical core.

9. The method according to claim 8, further comprising pulling the first thread and the second thread to secure the spherical core within the first half of the baseball cover and the second half of the baseball cover.

10. The method according to claim 6, further comprising positioning a first tube along a perimeter of the first half of the baseball cover, and positioning a second tube along a perimeter of the second half of the baseball cover.

11. The method according to claim 10, wherein moving the first thread along the first path includes moving the first thread around a portion of the first tube, and wherein moving the second thread along the second path includes moving the second thread around a portion of the second tube.

12. The method according to claim 6, further comprising temporarily securing the first half of the baseball cover to the film using magnets, and temporarily securing the second half of the baseball cover to the film using magnets.

* * * * *